United States Patent [19]

Titus

[11] Patent Number: 5,026,169

[45] Date of Patent: Jun. 25, 1991

[54] MIXER-DRYER

[75] Inventor: Hans-Joachim Titus, Kufstein, Austria

[73] Assignee: Krauss-Maffei AG, Munich, Fed. Rep. of Germany

[21] Appl. No.: 542,107

[22] Filed: Jun. 22, 1990

[30] Foreign Application Priority Data

Jun. 23, 1989 [DE] Fed. Rep. of Germany ..... 3920589
Sep. 6, 1989 [DE] Fed. Rep. of Germany ..... 3929502

[51] Int. Cl.[5] ..... B01F 9/22
[52] U.S. Cl. ..... 366/287; 366/314
[58] Field of Search ..... 366/186, 189, 194, 195, 366/196, 266, 287, 285, 318, 314, 261, 279

[56] References Cited

U.S. PATENT DOCUMENTS

| | | | |
|---|---|---|---|
| 4,123,174 | 10/1978 | Titus | 366/318 |
| 4,422,772 | 12/1983 | Baumgartner | 366/287 |
| 4,534,658 | 8/1985 | Vries | 366/287 |
| 4,588,301 | 5/1986 | Bolz | 366/287 |

*Primary Examiner*—Robert W. Jenkins
*Attorney, Agent, or Firm*—Shlesinger, Arkwright & Garvey

[57] ABSTRACT

The mixer of the invention consists of an upwardly flaring conical mixing container 10 comprising a spherical bottom 28 formed by a rotary head 26. The mixer screw shaft 32 rests in the rotary head and is sealed therein, entering the mixing container 10 from below. The rotary head is affixed to a support collar 24 resting centrally in a transmission housing 22 at the lower part of the container. This lower part of the container consists of a central housing 14 flanged onto the container and comprising an upper conical segment 15 extending the container wall and a lower cylindrical segment 18 sealing by means of axial face seals 44 the cylindrical outer side 42 of the rotary head inside a cylindrical, fitted bore. The lower flange of the transmission housing 22 connects to the drive support 70, 68 encapsulating completely all movable drive parts from the outside.

18 Claims, 3 Drawing Sheets

MIXER-DRYER

Figure 1:
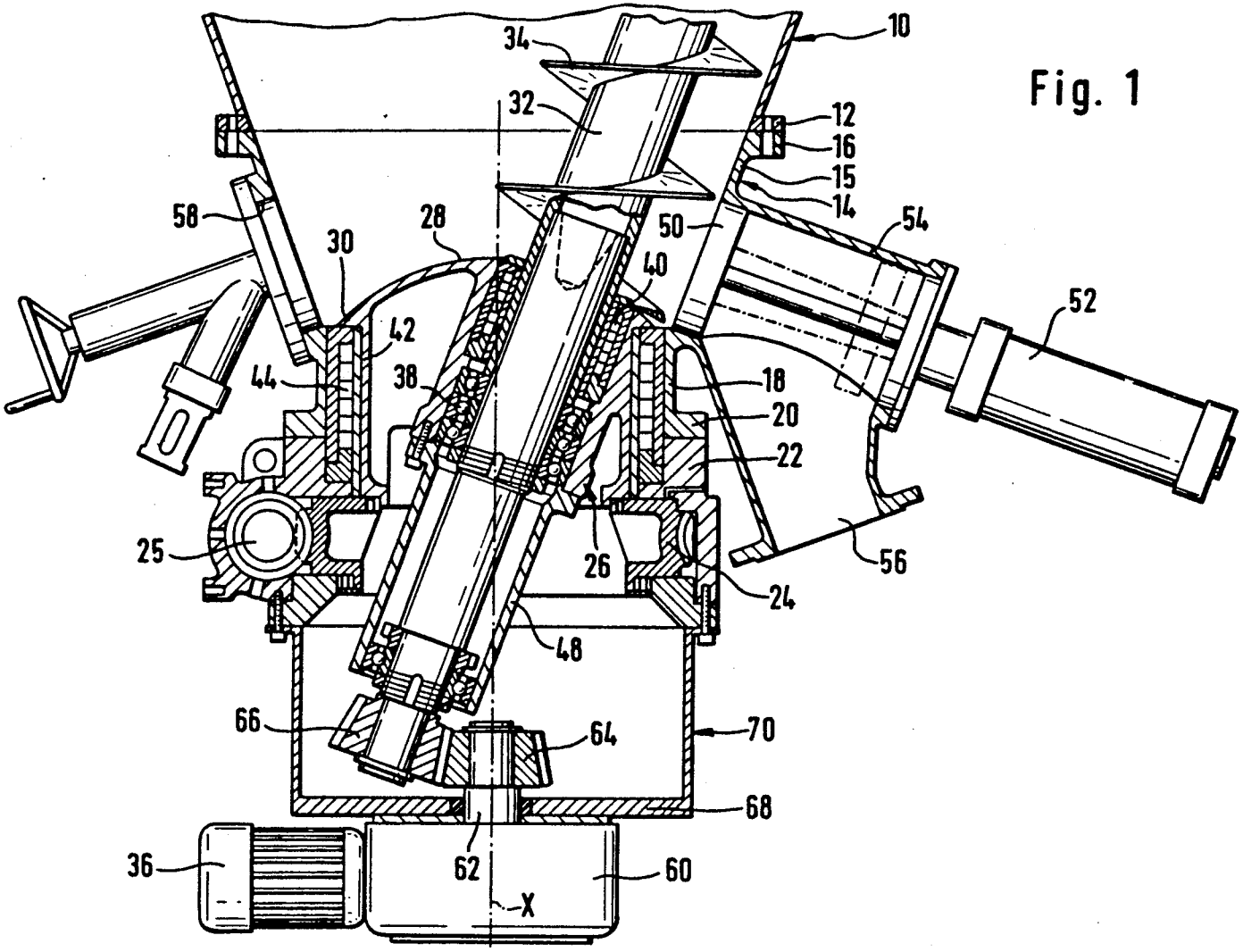

The invention relates to a conical screw-mixer preferably also operating simultaneously as a drier and comprising a conically upward flaring mixing container, a product discharge in the lower region of this mixing container, a hookup-unit connected to the lower end of the mixing container, a rotary head resting in the hookup unit and supporting the shaft entering the mixing container and bearing the mixing screw comprising mixing blades, said shaft being driven from the lower end, and a guide member resting in the hookup unit and driven in rotation about the vertical axis of the mixing container to impart a revolving motion along the container wall to the mixing screw.

A mixer of the above species disclosed in the German Offenlegungsschrift 24 52 005 is equipped at its lower end with a mixer-screw shaft passing through a spherical support housing. The spherical shells of the support housing are held in a retaining unit at the container bottom by means of seating components similar to swivel-joint sockets with packing-box stuffing therein. As this support forms the lower end of the mixing container, there is danger that both the bearing abrasion of the screw shaft and that of the support housing and of the joint socket shall enter the product in the mixing container and contaminate it.

As regards a mixer of a similar species disclosed in the German patent 26 27 259, a rotatable support housing sealed relative to the hookup housing comprises an upper, flaring segment which is entered by the blades of the mixing screw, and further a product discharge pipe which extends downward from a widened section of this support housing and subtending an angle with the axis of the mixing screw. This known design is a drawback to the extent that it demands a substantial space up to 2 m underneath the lower container flange, said spacing receiving not only the rotational drive of the screw shaft discharging downward but also a ballvalve mounted below the product discharge together with a rotary pipe joint. This rotary pipe joint is necessary because the screw moves along the sloping container wall also during product discharge.

The object of the invention is to so improve and further develop a mixer, or if called for a mixer-drier of the initially cited species, that the required design height for its operation and installation shall be reduced and that on the whole less equipment shall be required. Further, condensate formation at the lower end of the mixing condenser shall be reliably averted.

The following steps are proposed to solve the problem of the invention:

The discharge unit is a central housing with an upper conical segment extending the wall of the mixing container and comprising the product discharge aperture and other fittings of process technology, and includes a lower, cylindrical segment; the guide member consists of a horizontal support collar with external teeth which is guided and rests in a transmission housing mounted to the lower side of the cylindrical segment, the screw shaft together with the support housing enclosing it passing through said collar; the rotary head is mounted on the support collar and its cylindrical outer wall is sealed by an axial face seal relative to the cylindrical segment of the central housing.

An important concept in reducing the design height is that the lower, sharply tapering end of the mixing container—which has relatively little capacity—is abandoned by now relocating the support and the seal of the screw shaft into this freed lower container space. As a result, and also on account of the design of a central housing connected to the lower container end, it is possible, as regards one embodiment, to increase the previous diameter of the lower external container flange from 280 mm to a present value of 500 mm, this substantial saving in height being traded against merely a slight loss in volume of approximately 15%.

The feature of integrating the central housing between the lower transmission housing and the downwardly shortened mixing container offers the advantage that this construction unit can be prefabricated apart from the large mixing container and can be pre-assembled with the screw and transmission. The body of the central housing may be welded or cast, and because of its limited size can be easily machined, illustratively the cylindrical inner wall being fitted on a lathe to match an axial face seal at the periphery of the rotary head. Advantageously moreover, further apertures and flanges for fittings of all sorts may be present at the upper conical segment of the central housing besides the product discharge, which heretofore were located in the casing of the mixing container where, on account of the deformations caused by processing, they required costly, subsequent alignment work.

Another feature of the new design is that the rotary head supporting the screw shaft and sealed relative to the mixing container is fastened to the top side of the support collar resting in the hookup housing, whereby the cylindrical outer wall of the rotary head need not absorb any bearing forces, instead it is available solely for sealing relative to the opposite cylindrical section of the central housing by the insertion of axial face seals.

In a preferred embodiment, the rotary head may comprise a convex surface of shallow curvature facing upward into the mixing container and form its bottom, such a surface being especially suitable to avoid mixing dead spaces.

Because the rotary head with its preferred spherical surface enters comparatively deeply the mixing container from below, said surface is fairly large, for instance being determined by about twice the diameter of the mixing screw. On account of the large area of this surface facing the mixing container, controlled uniform heating of said surface is possible in the presence of welded-on heating ducts. This heating option is important because it reliably eliminates the formation of condensates and caking due to preceding moisture accumulation. Because of the special design of the support and drive being remote from the mixing container, it is possible to seal it in problem-free manner and to ensure sterility of mixed products in continuous operation. By avoiding support sites within the mixing chamber communicating with the product, even sensitive end products remain uncontaminated.

The rotary head being affixed to the support collar, and the relatively large diameter of this support collars in turn providing advantageous support in the transmission housing, are important features for the stability and support of the mixing screw and also for the compactness of the support and the sealing features inside the rotary head. The support collar enclosing the lower end of the screw shaft, together with its support, is easily capable of absorbing the substantial bearing and support forces of the mixing screw processing the product.

Further features and advantages are illustrated in the description below of an illustrative embodiment of the mixer of the invention in relation to the drawings showing details of this invention. The particular features from the claims and the description always may be implemented alone or in arbitrary combination in other embodiment modes of the invention.

The Figures are substantially schematic.

Figure 2:
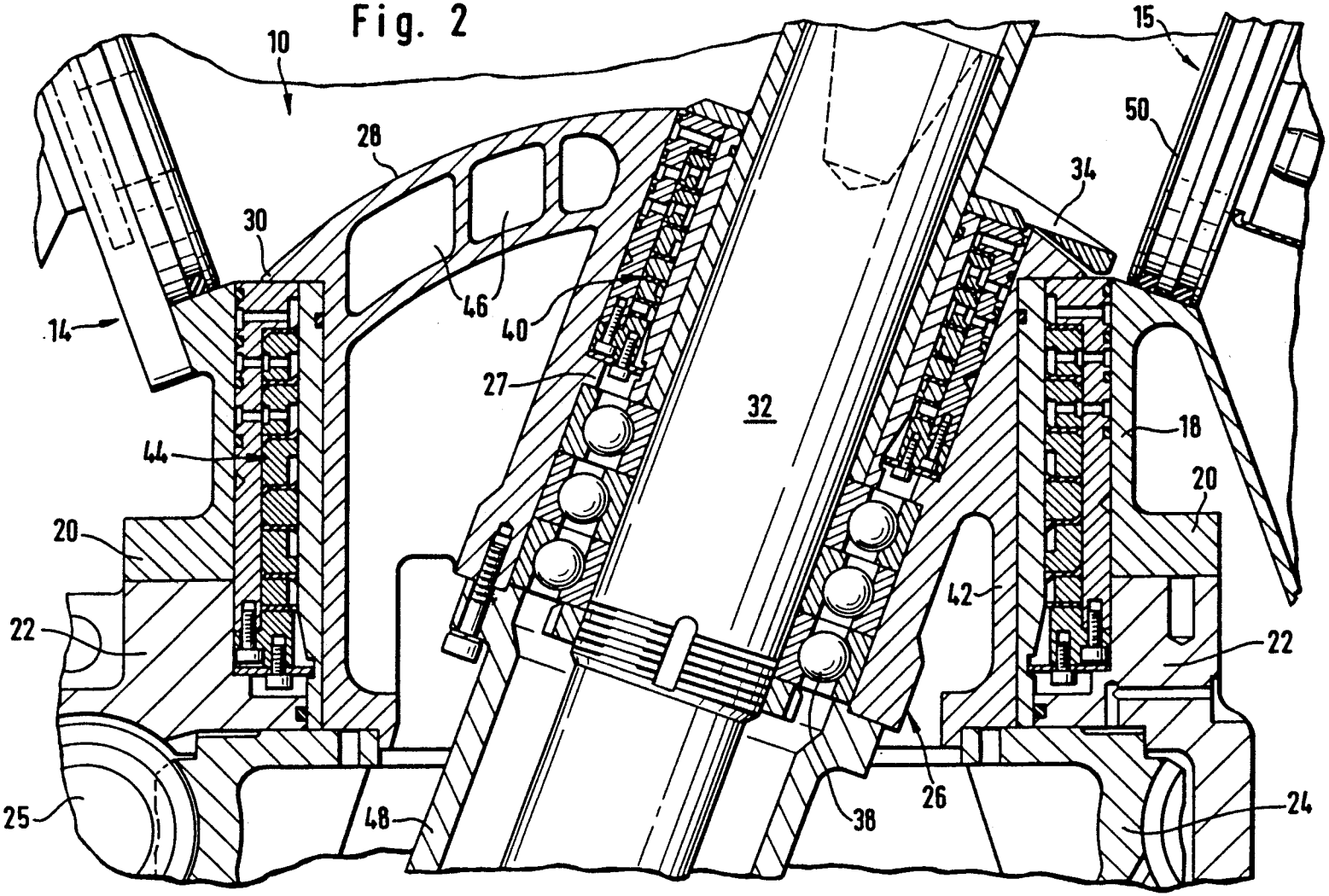
Figure 3:
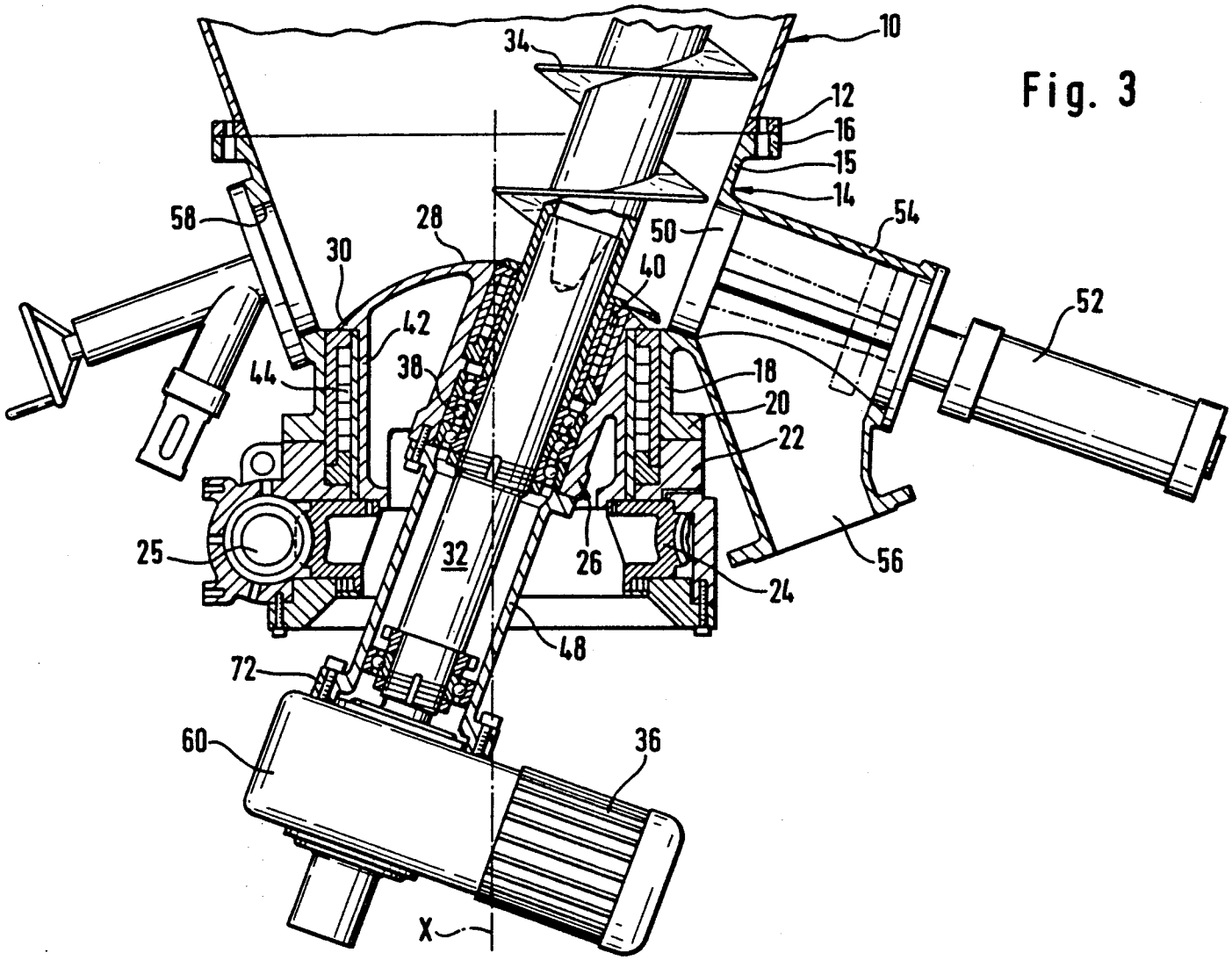

FIG. 1 is a vertical section through the lower region of a mixing container with mixing screw, drive and product-discharge, FIG. 2 is an enlarged representation of the rotary head of FIG. 1, and FIG. 3 is a variation of the embodiment of FIG. 1.

The lower region of the conical mixing container 10 is affixed by a lower flange 12 to an upper flange 16 of a separate central housing 14. The central housing 14 comprises an upper conical segment 15 and a lower cylindrical segment 18 with flange 20.

The conical segment 15 seats all fittings and accessories inclusive the product discharge aperture 50, the cylindrical segment to receive and seal the rotary head 42. Because the central housing 14 can be made by machine, wall perforations are absent from the container or silo cone, such perforations being especially costly in a double-casing or semi-tubular worm design of a drier variation and which would incur indentation because of welding. In that event, in spite of expensive dressing work, the screw would have to be held a large distance away from the container wall to prevent contact. Such enlarged distance would favor caking at the container wall when drying and would much lower the drying efficacy. The flange 20 of the central housing 14 is firmly connected by bolts to the transmission housing. A support collar 24 designed as a screw wheel rests in rotatable manner on all sides in the transmission housing 22 and its toothed outer surface meshes with a drive worm 25. A rotary head 26 is mounted on the top side of the support collar 24, for instance being affixed by screws. The rotary head 26 contains a guide-housing 27 receiving the screw shaft 32 with the bearings 38 and seals 40 surrounding it and sloping by about 20° to the longitudinal axis of the mixing container 10. A screw spiral 34 is affixed above the rotary head on the length of the screw shaft 32 entering the mixing container 10. Together with its supporting rotary head 26 and the support collar 24, the mixing screw forms an assembly rigid per se which as a whole rests by means of the support collar 24 in the transmission housing and rotates about the vertical center axis both of the mixing container 10 and of the support collar 24 in such manner that as a rule the mixing screw shall be guided parallel to and along the conical wall of the mixing container 10.

The upper side 28 of the rotary head 26 forms the lower boundary of the mixing container 10 and is concave in approximately spherical manner. An external rim zone 30 of the rotary head overlaps the axial face seal 44 between the cylindrical outer wall 42 of the rotary head 26 and the fitted inside of the cylindrical wall segment 18 of the central housing 14. The reaction and bearing forces caused by the mixing screw are transmitted practically completely from the rotary head 26 into the support collar 24 and into the transmission housing 22 supporting it. The absorption of these forces is enhanced by the screw shaft 32 extending together with the bearing sleeve 48 supporting it at the lower end passing through the support collar 24, whereby the support forces of the screw shaft are almost uniformly transmitted from below and above into the support collar.

It will be noted that the upper side 28 of the rotary head forming the bottom of the container subtends a comparatively large area but that on the other hand mixing dead spaces are averted on account of the hugging shape of the lower sides of the screw blades. The large area of the top side of the rotary head allows advantageous embodiments such as the ducts 46 integrated into the lower side as shown by FIG. 2 and assuring heating of the rotary head. However a plain double casing or soldered or welded heater coils also may be used to heat the upper side of the rotary head in lieu of the discussed heating ducts 46.

The casing 48 is affixed to the lower side of the guide housing 27 of the rotary head 26, which receives the shaft 32, and encapsulates the lower segment of the screw shaft 32 and a bearing mounted distance from the bearing 38 resting in the guide housing 27. As shown by FIG. 1, a conical gear 66 is keyed onto the lower end of the screw shaft 32 and serves as drive connector. The shown design for resting the lower end of the screw shaft and for the drive connector is not mandatory: other drive devices too are conceivable in order to minimize the total mixer height while retaining its capacity.

As regards the embodiment of FIG. 1, a preferably circular housing 70 is affixed to the transmission housing 22 and among other purposes serves to encapsulate the lower bearing end of the screw shaft and the gearing. However the closed housing may be replaced by a basket-like rest for the base plate 68 bearing the screw drive in order that the gear system 64, 66—being a dangerous site—be covered. An output shaft 62 issues from the reduction transmission 60 and is mounted in the extension of the center-axis X of the mixing container 10 and is sealed by a conical gear 64 while extending through the base plate 68 as far as into the housing 70.

When the mixing screw is made to rotate by means of the support collar 24 and the rotary head 26 mounted thereon, it is guided very closely along the inside wall of the mixing container, said rotation being either reversing or also only continuous in one direction. Before the above said rotation begins, a suitable circuit assures that previously the motor 36 driving the screw was turned ON, said screw continuously moving the mixed material in the mixing container from bottom to top.

A preferred direction of rotation initiated by that of the support collar 24 and the rotary head 26 is implemented in such manner that the reaction of the unilaterally supported mixing screw due to the mixing good always shall be deflected inward, that is away from the wall of the mixing container 10. As a result a comparatively small spacing between the screw turns and the container wall can be achieved, and thereby thorough and intensive, i.e. homogeneous mixing of the material, while at the same time the danger is averted of contaminating this mixing material by abrading the screw turns against the container wall. The housing 70, alternatively also a basket-like holding means for the base plate 68, serves as a safety or protective cover for the lower driven end of the mixing screw, and thereby moving parts that otherwise might be dangerous to the personnel shall always be encapsulated.

The total height of the detachable central housing 14 is designed in such manner that when pivoting, together with the mixing screw, the lower part 14 about a connecting point between its upper flange 16 and lower flange 12 of the mixing container 10, a comparatively large pivot angle shall be possible. If it is assumed with respect to FIG. 1 that said omitted connecting point is on the right and was freed by loosening the connecting screws, then the central housing together with the mixing screw therein can be pivoted counter-clockwise into a sloping position of about 45°, whereby it is possible to leave the screw undivided and to pull it from the normally operating stage downward out of the container or, during assembly, to insert it from below into the container.

As shown by FIG. 1, a product discharge aperture is present sideways in the conical segment 15 of the central housing 14 and is normally closed by a lid 50 sealed at its rim. The lid is displaceable by means of a pressurized cylinder 52 in a longitudinal guide 54 that opens and closes the product discharge. A downwardly directed discharge duct 56 is directly connected to the longitudinal guide 54. Furthermore one or more inspection apertures 58 with devices for sampling or for measuring the temperature, moisture etc. are provided over the periphery of the conical segment 15.

By having moved the rotary head 26 serving as a support housing for the mixing screw as far as into the region of larger mixing container diameter, the possibility is now given to also provide a larger diameter to the mixing screw. A larger mixing screw diameter assures increased rate of kneading of the mixed material. This higher mixing intensity was impossible in previous designs because the screw had to pass through the support housing. Moreover the upward relocation of the rotary head results in increased bottom area of the mixing container and hence in increased area of the top side 28 of the rotary head. This area gain now makes possible heating the container bottom even in small mixers and thus to prevent undesired formation of condensates.

The variation shown in FIG. 3 differs from the embodiment of FIG. 1 by the rotation drive unit 36, 60 being directly mounted to a lower flange 72 of the support sleeve 48—rather than to the encapsulated lower end of the screw shaft 32. On account of this design, the drive unit 36, 60 flanged onto the support sleeve 48 moves together with the support collar 24, and the screw shaft 32 moves during mixer operation about the vertical container axis X.

I claim:

1. A mixer, comprising:

(a) a container flaring conically upwardly and having a conical inside wall and an open lower end portion;

(b) a connecting unit detachably secured to said container lower end portion, said connecting unit including a conical upper portion and a cylindrical lower portion, said conical upper portion forming an extension of said container wall and including a product discharge aperture;

(c) a rotary head operably secured in said cylindrical lower portion, said rotary head being rotatable about a vertical axis of said container;

(d) means for sealing said rotary head relative to said cylindrical lower portion;

(e) said rotary head including a surface communicating with the interior of said container and forming a bottom surface of said container;

(f) a transmission housing operably secured to said cylindrical lower portion;

(g) a horizontal support collar operably secured in said transmission housing, said collar being operably secured to said rotary head and rotatable therewith about said vertical axis;

(h) a mixing screw having a shaft portion extending through said rotary head and said support collar;

(i) means operably associated with said shaft portion for rotatably driving said screw along its longitudinal axis; and (j) means for rotating said rotary head, thereby moving said screw parallel to and along said container conical wall.

2. A mixer as in claim 1, wherein:

(a) said support collar includes a top surface; and (b) means for detachably securing said rotary head to said support collar top surface.

3. A mixer as in claim 1, wherein:

(a) said rotary head comprises a guide housing operably associated with said shaft portion, said guide housing disposed at an angle relative to said vertical axis.

4. A mixer as in claim 3, wherein:

(a) said guide housing includes upper and lower portions;

(b) said shaft portion is supported at said guide housing lower portion; and (c) means disposed in said guide housing upper portion for sealing said shaft portion relative to said guide housing.

5. A mixer as in claim 4, and further comprising:

(a) bearing means disposed in said guide housing lower portion for rotatably securing said shaft portion;

(b) said rotary head includes an outer cylindrical wall; and (c) said guide housing extends over substantially the same height as said cylindrical outer wall.

6. A mixer as in claim 3, wherein:

(a) said shaft portion includes an end portion; and (b) a support housing operably secured to said guide housing and operably associated with said end portion of said shaft portion.

7. A mixer as in claim 1, wherein:

(a) said rotary head includes a cylindrical wall;

(b) said transmission housing includes an upper portion operably secured to said cylindrical lower portion and defining a bore therewith;

(c) said rotary head is disposed within said bore and defines a space between said cylindrical wall and said bore; and (d) sealing means disposed within said space for sealing said rotary head relative to said bore.

8. A mixer as in claim 1, wherein:

(a) said surface is upwardly curved into the interior of said container.

9. A mixer as in claim 8, wherein:

(a) said surface is partly spherical.

10. A mixer as in claim 1, and further comprising:

(a) heating ducts operably associated with said surface for heating said surface.

11. A mixer as in claim 1, wherein:

(a) said surface includes double casing means for heating said surface.

12. A mixer as in claim 1, wherein:

(a) said container lower end portion includes a flange; and (b) said conical upper portion includes a flange secured to said container lower end portion flange.

13. A mixer as in claim 1, wherein:

(a) said upper conical portion includes inspection apertures, viewing glasses and flanges for fittings.

14. A mixer as in claim 1, wherein said driving means comprises:

(a) a motor;

(b) a reduction gear coupled to said motor;

(c) a first conical gear coupled to said reduction gear;

(d) a second conical gear coupled to said first conical gear and to an end portion of said shaft portion; and (e) a base plate operably secured to said transmission housing for supporting said motor, said reduction gear, and said first conical gear.

15. A mixer as in claim 14, and further comprising:

(a) a skirt extending from said base plate and detachably mounted to said transmission housing for enclosing said first and second conical gears and said shaft end portion, thereby providing a protective enclosure for moving parts disposed therein.

16. A mixer as in claim 1, wherein:

(a) said support collar includes peripheral teeth; and (b) said rotating means includes a drive worm gear operably associated with said peripheral teeth.

17. A mixer as in claim 1, wherein:

(a) said driving means and said rotating means are adapted to operate such that reaction forces developed by material being mixed will tend to push said screw away from said container wall during mixture operation.

18. A mixer as in claim 1, wherein:

(a) said container open lower end portion has a diameter adapted for permitting a sufficiently large pivot angle for said connecting unit upon detachment of said connecting unit from said container, thereby facilitating assembly and disassembly of said mixing screw from said container.

* * * * *